United States Patent [19]

Okamoto

[11] 4,342,188

[45] Aug. 3, 1982

[54] PIRN EXCHANGE APPARATUS IN DOUBLE TWISTER

[75] Inventor: Akira Okamoto, Joyo, Japan

[73] Assignee: Murata Kikai Kabushiki Kaisha, Joyo, Japan

[21] Appl. No.: 147,924

[22] Filed: May 8, 1980

[30] Foreign Application Priority Data

May 11, 1979 [JP] Japan ..... 54-58445

[51] Int. Cl.[3] ..... D01H 7/22; D01H 7/86

[52] U.S. Cl. ..... 57/89; 57/58.72; 57/266

[58] Field of Search ..... 57/88, 266, 89, 58.49, 57/58.72

[56] References Cited

U.S. PATENT DOCUMENTS

| | | | |
|---|---|---|---|
| 2,478,928 | 8/1949 | Carter et al. | 57/89 |
| 2,599,256 | 6/1952 | Hartley et al. | 57/89 X |
| 2,786,324 | 3/1957 | Keith et al. | 57/89 |
| 3,264,812 | 8/1966 | Scragg | 57/89 X |
| 3,292,358 | 12/1966 | DiMeglio et al. | 57/89 |
| 3,815,348 | 6/1974 | Wachendorf et al. | 57/89 X |
| 4,257,220 | 3/1981 | Menegatto | 57/89 |

*Primary Examiner*—John Petrakes

*Attorney, Agent, or Firm*—Moonray Kojima

[57] ABSTRACT

A pirn exchange apparatus in double twister includes a bolster supporting a wharve of a spindle unit thereon. The bolster is mounted on a machine stand rotatably with one axis being as the center so that the bolster with the spindle unit is shifted in a tilting manner between the twisting position and the pirn exchange position.

5 Claims, 6 Drawing Figures

PIRN EXCHANGE APPARATUS IN DOUBLE TWISTER

BACKGROUND OF THE INVENTION

In pirns which are supplied to a double twister, the size of the pirns in the axial direction is larger than the diameter of the yarn layer, and it is generally 320 mm to 460 mm, but it is known that in some pirns, this size is larger or smaller outside this range. In mass production of garments and clothes, pirns having a longer length and a larger diameter are advantageous. However, in the aesthetic use, pirns having a shorter size and a smaller diameter are advantageous. When it is desired to obtain strongly twisted yarns for the aesthetic purpose, if the rotation number of the spindle is the same, the size may be short because a low speed is adopted for manufacture. If the rotation number of the spindle is increased, a small size of a rotary disc is advantageous. Also for this reason, a pirn having a smaller diameter is preferred.

However, in any fields, the length of pirns is inevitably larger than that of cheeses of spun yarns. If the production rate is increased by adopting a so-called two-deck type machine in which spindles are arranged in two lines, since the pirn length is large, the machine height is increased, with the result that a new building becomes necessary for introduction of this machine and the operation adaptability is reduced. If this machine height does not cause a serious disadvantage, as the lay-out of the machine, it is sufficient if a spindle unit, a feed roller and a winding zone are arranged in series in the longitudinal direction. An instance of the conventional technique in which the above problem is solved is shown in FIG. 1. A machine frame 3 is expanded above a spindle unit U vertically mounted on a spindle rail 1, and a guide roller 4, a feed roller 5 and a driving roller 6 for a package PM are arranged on this frame 3. The guide roller 4 is disposed above a yarn supply pirn P to determine the winding angle of the yarn to the feed roller 5.

Since the length of the yarn supply pirn is large as pointed out hereinbefore, it is necessary to prevent the pirn from falling down while twisting is carried out by the rotating spindle. Accordingly, if a wharve 7 is rotated by a belt BL as in the known technique, a rotary disc 8 integrated with the wharve 7 is rotated while a stationary disc 9 placed on the top end of the spindle through bearings BR, that is, the above rotary disc 8, is prevented from rotating by a magnet MG. A guide post 10 is mounted in the central portion of the stationary disc and the pirn P is vertically inserted in this guide post 10. In some case, a tension device or the like is additionally attached to the guide post 10. The size of the guide post 10 is about $\frac{2}{3}$ of the size of the pirn P. Since a tension device T and a yarn guide member G are placed on the top end of the pirn, when a new pirn is vertically inserted in the post 10, the pirn should be inserted from the position about 2 times as high as the height thereof. Accordingly, the guide roller 4 should be disposed at a considerably elevated position and the frame should be raised up considerably.

A stationary snail guide SG is disposed just above the pirn. The length between this snail guide SG and an opening 11 of the rotary disc 8 has serious influences on the shape and size of the pirn and the yarn tension, and it is not permissible to locate the snail guide at a much elevated position, that is, the position about 2 times as high as the pirn height, which is necessary for vertical insertion of the pirn. As means for solving this problem, of course, there may be adopted a method in which the snail guide is turned and let to escape when the pirn is inserted in the stationary disc.

Accordingly, even if it is possible to render the snail guide movable, the above-mentioned disadvantage is inevitably caused if the position of the guide roller 4 is elevated.

As means for solving this problem, there has been proposed a method in which a flexible member, for example, a coil spring is used as the guide post 10 and is deformed to the right in FIG. 1 and the pirn is inserted and vertically disposed on the stationary disc. However, this method is defective in that if the rotation number is increased for the high speed operation to 10,000 to 20,000 rpm, stable maintenance of the pirn is difficult by vibrations of the spindle. Furthermore, there has been proposed a method in which the spindle rail 1 is divided in segments for the respective units, the spindle unit as a whole is turned to the right in FIG. 1 and taken out and the spindle unit is returned to the original position after insertion of the pirn. However, this method is defective in that many parts are necessary for taking out the spindle unit and the machine becomes expensive. Furthermore, in case of a two-deck type machine, the travel of a truck for operators in the direction rectangular to the paper face in FIG. 1, that is, in a direction parallel to the spindle rows, on the right side of FIG. 1 is inhibited when the spindle unit is taken out.

SUMMARY OF THE INVENTION

The present invention relates to a pirn exchange apparatus in a double twister for twisting a filamentary yarn wound in the form of a pirn.

An object of the present invention is to provide a novel pirn exchange apparatus by which the pirn can be inserted and attached to the stationary disc placed on the top end of the spindle very easily by automatically or manually operating the lever.

Another object of the present invention is to provide an apparatus in which the spindle can easily and precisely be tilted and shifted between the twisting position and the pirn exchange position.

Still another object of the present invention is to provide a double twisting machine having extremely reduced height thereof.

According to the present invention, the above mentioned problem in the conventional machines is solved by tilting the spindle unit with respect to the spindle rail 1 and returning it to the original position after insertion of the pirn.

DETAILED DESCRIPTION OF THE INVENTION

The present invention will now be described in detail with reference to embodiments illustrated in the accompanying drawings.

Figure 2:
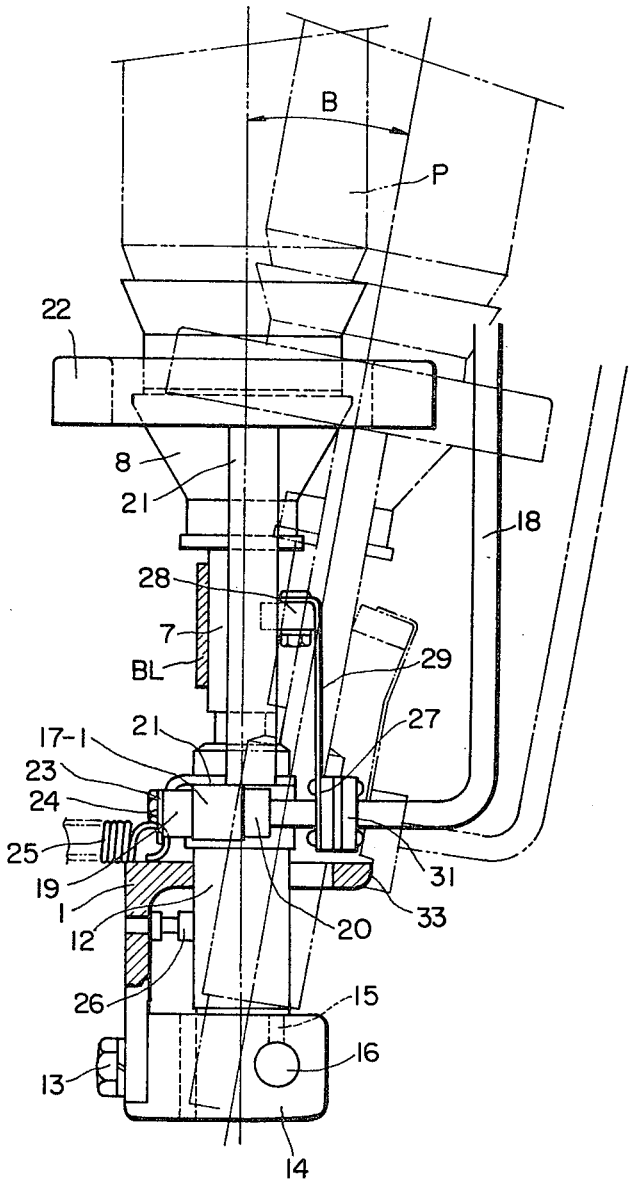
FIG. 2 is a side view showing the first embodiment of the present invention.
Figure 3:
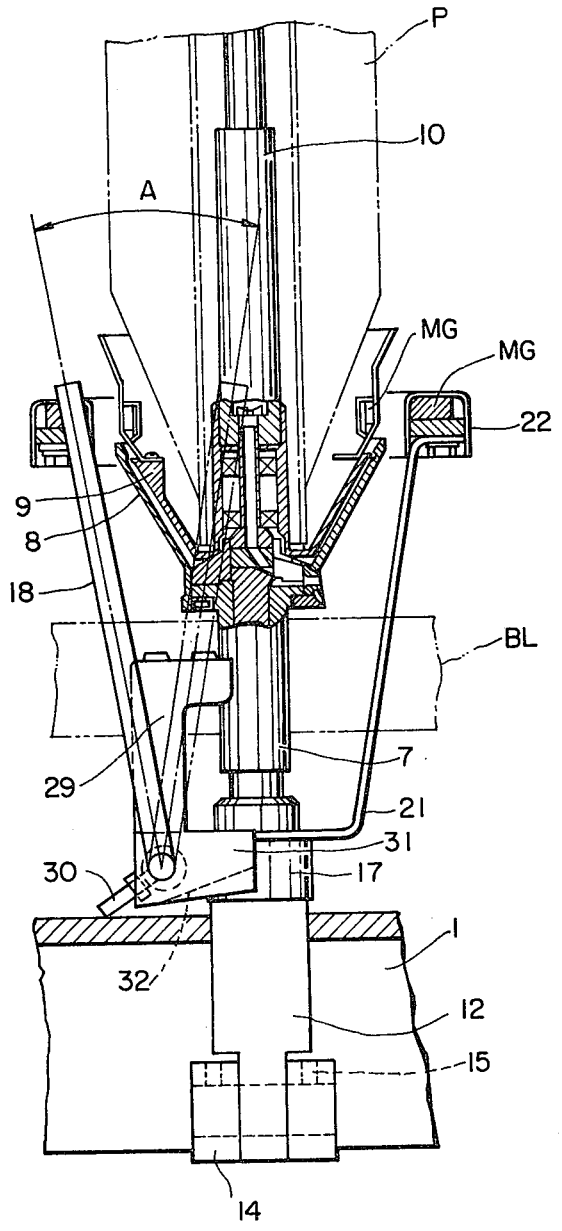
FIG. 3 is a front view of the first embodiment.

Referring to FIGS. 2 and 3, a wharve 7 is mounted on a bolster 12 through a spindle blade not shown in the drawings. A hole is formed on the lower end of the bolster 12 and a shaft 16 is secured to a bracket 14 fixed at the point 13 to a spindle rail 1, through a knock pin 15. The shaft 16 is freely inserted in the hole of the bolster 12 so that the bolster 12 can be turned with the shaft 16 being as the center.

A bracket 17 is fixed to the bolster 12, and a bracket 17-1 is integrated with or fixed to the bracket 17, and one end of an operation lever 18 is inserted through this bracket 17-1 and the lever 18 is fixed by members 19 and 20 so that the lever 18 can be freely turned but this insertion is not set free. Accordingly, the lever 18 is fixed in the direction perpendicular to a driving belt for rotating spindles arranged in rows, that is, in the direction of tilting of the bolster with the shaft 16 being as the center.

A bracket 21 is secured to the bracket 17, and a ballon controlling ring 22 having a magnet MG disposed therein to prevent rotation of the stationary disc is secured to the bracket 21.

Furthermore, a bracket 23 is secured to the bracket 17 at the position 24, and a spring 25 is hung in a hole formed on the bracket 23. The other end of the spring 25 is hung on the machine frame or on a corresponding bracket 23 of the spindle unit located on the back of the present spindle unit. Reference numeral 26 represents a stopper, the position of which can be freely adjusted. Together with the above-mentioned spring 25, this stopper 26 acts on the wharve 7 so that it is brought into contact with a driving belt BL. A modification may be made so that this stopper 26 brings the wharve 7 into contact with the spindle rail 1, or the bracket 14 may be modified so that the wharve 7 is brought into contact with the bracket 14, whereby a cushioning effect is attained on the wharve per se or on the side of the stopper.

The operation lever 18 has an L-figured shape as shown in FIG. 2, but this shape is not particularly critical but other shapes may be adopted. A brake shoe 28 is fixed to the operation lever 18 through an attachment member 27. A plate spring 29 is disposed as a member connecting the attachment member 27 to the brake shoe 28. A stopper 30 is secured to the operation lever 18 so that when the operation lever 18 is located at a position indicated by a solid line in FIG. 3, this stopper 30 falls in contact with the rail 1 to set the position of the lever 18. An arcuate notch 38 (see FIG. 4) is formed on the brake shoe 28 so that a shape suitable for contact with the wharve 7 is given to the brake shoe 28.

Figure 1:
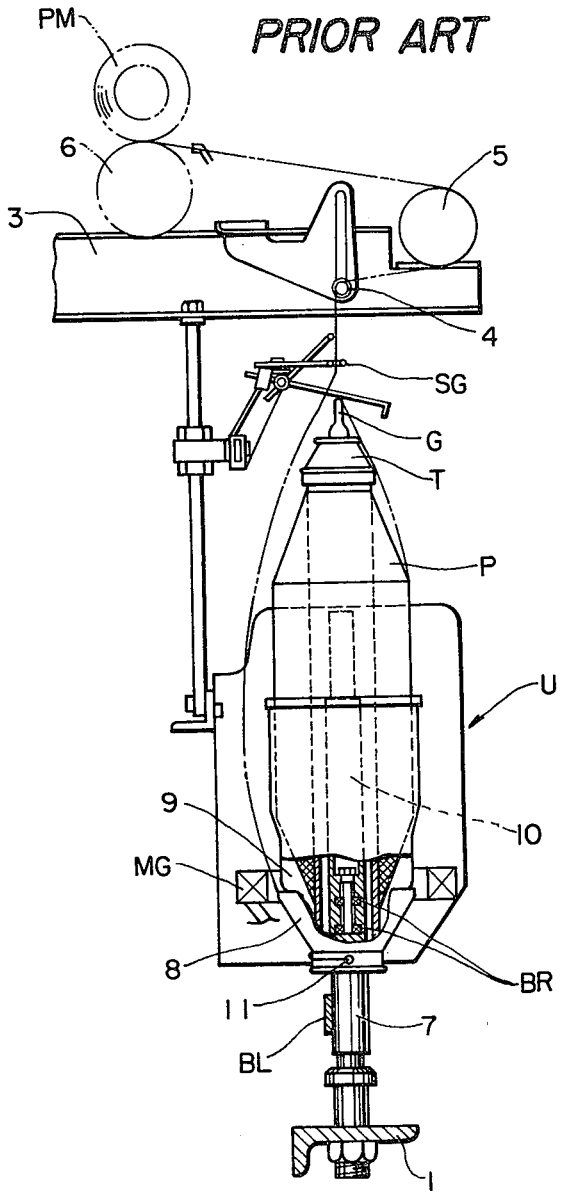
FIG. 1 PRIOR ART
FIG. 1 is a diagram illustrating the double twister.
Figure 4:
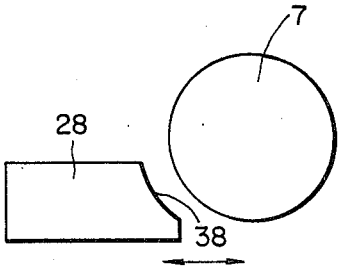
FIG. 4 is a diagram illustrating the relation between the brake shoe and the wharve in the first embodiment.

In the embodiment illustrated in FIGS. 2, 3 and 4, on the pirn exchange operation when the operation lever 18 is turned by an angle A of about 20° clockwise in FIG. 3, the brake shoe 28 is brought into contact with the wharve 7 to stop rotation of the spindle. When the operation lever 18 is brought down by an angle B of about 10° from the position of the solid line to the position of the dot line against the spring 25 as shown in FIG. 2, the rotary disc 8, stationary disc 9 and balloon controlling ring 22 together with the bolster 12 are integrally tilted from the twisting position to the pirn exchange position with the shaft 16 being as the center. Since a notch 32 of a stopper member 31 fixed to the operation lever 18 together with the attachment member 27 has a shape suitable for contact with the top end 33 of the spindle rail 1 at this point, the engagement of the stopper 31 with the spindle rail 1 is maintained by this shape of the notch 32 as well as the action of the spring 25. Thus, the pirn exchange position suitable for exchange of pirns P on the guide post 10 is produced. The inclination angle B is appropriately set so that the yarn guide member G placed on the pirn P is tilted on the right side of the feed roller 5 in FIG. 1.

Figure 5:
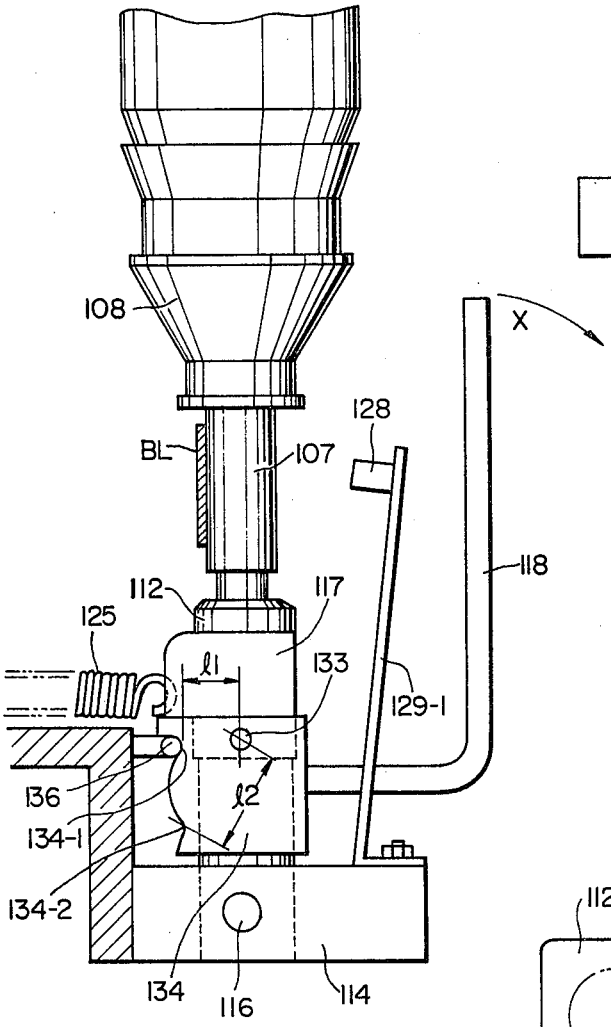
FIG. 5 is a side view showing the second embodiment of the present invention.
Figure 6:
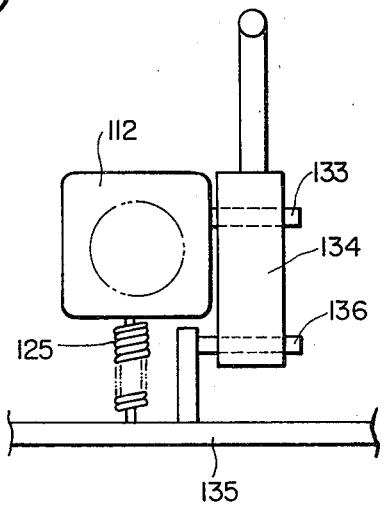
FIG. 6 is a diagram illustrating the cam portion in the second embodiment.

Another embodiment of the present invention is illustrated in FIGS. 5 and 6. In this embodiment, a cam 134 is rotatably mounted on a pin 133 secured to the bracket 117, and the operation lever 118 is fixed to the cam 134. This cam 134 receives the action of the spring 125 and falls in engagement with a pin 136 secured to a machine frame 135. The distances l1 and l2 of dents 134-1 and 134-2 from the pin 133 are different from each other, and if the operation lever 118 is brought down in the direction indicated by arrow X, the bolster 112 is turned with the shaft 116 being as the center.

In this embodiment, the member 29 in the first embodiment is secured to the bracket 114 and a plate spring or a member having an elastic force is used as the member 129. This embodiment is different from the first embodiment mainly in whether the spindle is taken out forward while being rotated or it is taken out forward while the spindle is completely or substantially stopped, when the operation lever 18 or 118 is turned.

As will be apparent from the foregoing illustration, according to the present invention, the spindle can easily and precisely be tilted and shifted between the twisting position and the pirn exchange position, and pirns can be exchanged advantageously. Furthermore, the entire machine height can be reduced.

What is claimed is:

1. In a double twisting apparatus comprising a spindle having a wharve and upon which a pirn is placed;

a support means;

a driving belt positioned to have its longitudinal flat surface contactable with the periphery of the wharve to cause rotation of said wharve;

a bolster for holding said wharve, said bolster being pivotally supported by said support means to have said wharve movable in directions toward and away from said driving belt;

brake means for braking rotation of said wharve; and pirn exchange means for enabling exchange of said pirn;

the improvement wherein said pirn exchange means comprises operation lever means movable in a direction parallel to said driving belt, and in a direction perpendicular to said driving belt;

means for mounting said lever means on said bolster for moving said bolster in a direction perpendicular to said driving belt;

spring means connected to said lever means and held by said support means;

said brake means being connected to said lever means and adjacent to said wharve, whereby movement of said lever means in a direction parallel to said belt moves said brake means to brake rotation of said wharve; and positioning means connected to said lever means for holding said brake means in a braked condition until released, and for holding said lever means and said wharve in a tilted replacement position until released, whereby after said brake means brakes said wharve and is held in a braked condition, said lever means against resilient force of said spring means is movable in a direction perpendicular to the belt to thereby cause said wharve to move away from said belt into a tilted replacement position whereby said positioning means holds said wharve in said tilted replacement position.

2. The device of claim 1, wherein said positioning means comprises a stopper member fixed to said lever means, and having a notch thereon, said notch being in contact with said support means in the tilted replacement position of said wharve.

3. The device of claim 2, wherein a plurality of spindle units are provided in a row, and wherein said operation lever means further comprises members fixed at one end of said operation lever means to a bracket to be freely turned in a parallel direction to said row of spindle units, wherein said brake means comprises a brake shoe and means fixed to said operation lever means whereby said brake shoe is brought into contact with said wharve to stop rotation of said spindle unit by the turning operation of said operation lever means in parallel to said spindle units.

4. The device of claim 1, wherein said positioning means comprises a pin secured to a bracket, and cam means rotatably mounted on said pin, said cam means having two dents thereon which are arranged to be different from each other in the distances from said pin, and said operation lever means is fixed to said cam means.

5. The device of claim 4, wherein said braking means comprises a spindle rail, an elastic member and a bracket fixed to said spindle rail, and wherein said brake shoe is mounted on said bracket by means of said elastic member, whereby when said operation lever means is turned said brake shoe falls into contact with said wharve.

* * * * *